United States Patent [19]

Russell

[11] 4,262,587

[45] Apr. 21, 1981

[54] STRAPPER FEED CONVEYOR

[76] Inventor: B. Carson Russell, 12821 Marcy St., Omaha, Nebr. 68154

[21] Appl. No.: 49,069

[22] Filed: Jun. 18, 1979

Related U.S. Application Data

[63] Continuation of Ser. No. 804,319, Jun. 8, 1977, abandoned.

[51] Int. Cl.[3] ..... B65B 13/06

[52] U.S. Cl. ..... 100/4; 100/7; 100/14; 100/26; 53/76; 53/589

[58] Field of Search ..... 100/4, 7, 14, 26; 53/76, 589, 591

[56] References Cited

U.S. PATENT DOCUMENTS

| | | | |
|---|---|---|---|
| 3,057,289 | 10/1962 | Luthi | 100/14 |
| 3,115,085 | 12/1963 | Van de Bilt | 100/14 X |
| 3,196,779 | 7/1965 | Embree | 100/14 X |
| 3,965,811 | 6/1976 | Mae | 100/4 |

FOREIGN PATENT DOCUMENTS

| | | | |
|---|---|---|---|
| 1073145 | 6/1967 | United Kingdom | 100/14 |

*Primary Examiner*—Billy J. Wilhite

*Attorney, Agent, or Firm*—Hiram A. Sturges

[57] ABSTRACT

A conveyor in combination with a strapper for strapping objects on the conveyor automatically as the conveyor is automatically stopped in many pre-selected places.

5 Claims, 4 Drawing Figures

STRAPPER FEED CONVEYOR

This is a continuation, of application Ser. No. 804,319, filed June 8, 1977 now abandoned.

BACKGROUND OF THE INVENTION

The prior art has lacked many features defined in the objectives of this invention as set forth herebelow.

An important object of the invention is to provide a pneumatic circuit, capable of controlling the conveyor and the strapper in a manner so as to apply at least one strap on to an object at a desired location with respect to an end of the object, and which is controllable by one single contact control, so that the position of the forward end of the object moving through the machine determines automatically the position of a first strap, the same pre-set programmed distance from forward end of an object to strap position being repeated automatically on subsequent objects moving through the machine.

Another objective is to provide an air circuit as described which can be changed so as to space the first strap a different preselected distance from a forward end of an object moving through.

A further object is to provide an air circuit capable of controlling automatically the placement of a second strap on an object, responsive to the passing of the rearward end of the object past a given point on the machine so that even if an object is ten feet long, while the previous object was only one foot long, nevertheless, the ten foot object will receive its rear end strap the same preselected distance from the rearward end of the ten foot object as was rearward end strap spacing from the end of the previous one foot object.

Still another objective is to provide for the use of the same upward and downward moving trigger for downward movement as the forward end of an object depresses the trigger initiating the first strap cycle and upward movement of the same trigger as the rearward end of the object passes, thereby releasing the spring biased trigger to move upward, thereby initiating the rearward end strap cycle.

Another object of the invention is to provide an air circuit for control of such a machine which as a time lapse for the application of the first strap after the pressure of the trigger by the front of an object being adjustable independently of adjustment of the time lapse between passage of the rearward end of the object past the same control trigger and the application of the second strap. In this way the invention provides for the placing of a first strap at one distance from the forward end of an object and the placing of the last strap on the object at a different distance if desired from the rearward end of the object.

A still further object is to provide an air circuit mechanism for initiating a third strap intermediate the front and rear straps on an object, the third and intermediate strapping cycle being initiated by the simultaneous depression of the trigger used for initiating the application of the front strap, and a second trigger disposed rearwardly on the machine with regard to object directional motion, the second trigger being called the intermediate strap trigger. Such simultaneous depression of the second or intermediate strap trigger and the first or front strap initiating trigger in effect calling upon the air circuitry to realize that the object is long enough to depress both triggers and, therefore, the object is in need of at least one intermediate strap disposed between the front and rear straps on the object. The number of intermediate straps being pre-set by two factors, the first factor being a setting of just how far apart straps shall be placed with respect to a previous strap. A second factor being the length of the object itself, whereby the intermediate strapping initiation circuit places one or more straps on the object proportional to how many units of distance there are in its length when one unit of distance is considered to be the distance between intermediate straps.

Still another object is to provide an intermediate strapping initiation air circuitry which will place the first of the intermediate straps at a variable pre-set distance behind the front strap of the object.

A further object is to provide an air circuit for such a machine which is capable of being set so that no strapping cycles are automatically triggered, but instead so that the only straps to be placed on an object are one or more straps placed in response to a manual triggering.

A still further object is to provide air circuitry for initiating the application of the front strap on an object by means of depressing a first trigger which opens a four-way valve so as to cause air from a general air source to flow through a first flow control freely to a cylinder on one side of its piston for causing the piston to move gradually toward a position for piston actuation of front strapping on the object, the speed of motion of the piston being regulated by a flow control in a line leading from the other side of the piston to atmospheric exhaust, the timing of the second mentioned flow control determining the time between first triggering by the object and application of the first strap, the completion of movement of the plunger in a first direction resultant from the first triggering to a trip point at which a first belt stop initiation valve is actuated.

BRIEF DESCRIPTION OF THE DRAWING

In FIG. 1 many parts are broken away to show parts that are behind and other parts are shown diagrammatically, such as a chain and its sprockets being shown in dotted lines. The position of a box being strapped is shown in dotted lines above the conveyor of this invention.

DESCRIPTION OF THE PREFERRED EMBODIMENT

Figure 1:
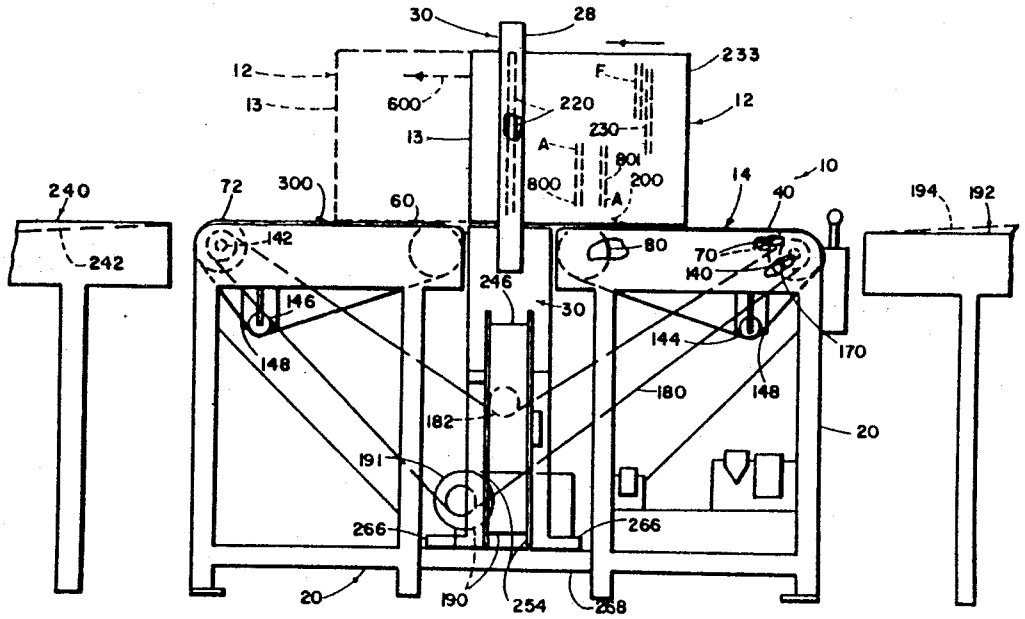
FIG. 1 is a side elevation of the strapper feed conveyor of this invention shown with end portions only of an in-feed ramp and an out-feed ramp, which latter can have inclined tops as indicated in dotted lines as optional to being level.

The strapper feed conveyor of this invention is generally indicated at 10 in FIG. 1, and its purpose is to deliver material, such as a box shown in dotted lines at 12, to a position beneath the yoke 28 of a strapper 30. The strapper is not shown in detail since it is a part of the prior art.

The conveyor 10 has a table top 14 having a frame 20 above which are an in-feed pair of conveyor belts 40 on one side of the strapper 30 and an out-feed conveyor belt pair 60 disposed on the other side of the strapper 30.

The belts 40 run at the same speed as the belts 60 so that movement of a box 12 along the conveyor 10 is smooth, even though it is intermittent, as later described.

The belts 40 are mounted on a pair of belt drive pulleys 70, respectively, which latter rotate at the same speed, being mounted on the same shaft 140.

The out-feed conveyor belts 60 rotate at a same speed as each other being mounted on pulleys 72 of a same diameter as the pulleys 70, and which latter are mounted on a same shaft 142.

The belts 40 and the belts 60 are each also carried by respective idler pulleys 144 and 146 which are adjustably carried for regulating tension on pulley carriers 148 fixed to the frame 20.

The axles 140 and 142 are driven by sprockets 170 on each of which an endless chain is drivably disposed, the same chain 180 extending under an idler pulley 182 and being driven by a reduction gear motor 190, which latter is driven by an air clutch having a torque limiter feature, later described.

It is an objective of the machine to be able to put a strap near the front of a box and another strap near the back of the box as a basic strapping of any object. In addition to that, it is a purpose of another part of the machine, later described, to place the strap or straps in between the two end straps.

Figure 2:
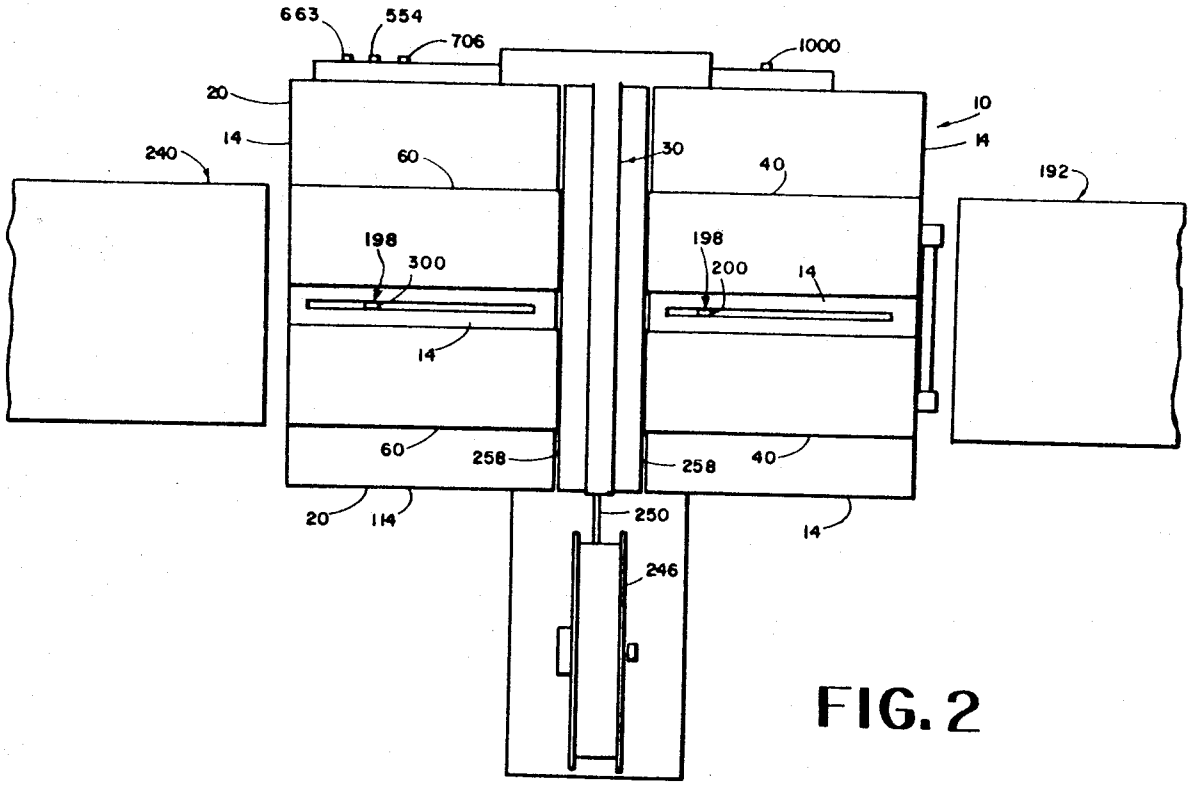
FIG. 2 is a top plan view of the strapper feed conveyor of this invention showing the in and out ramps partially thereon.

When the box 12 has passed on to the strapper feed conveyor 10 from an in-ramp generally indicated at 192 and optionally having an inclined upper surface, as seen at 194 in dotted lines; the box is carried on to the conveyor 10 of this invention by the motion of its belts 40 until such time as the forward end of the box, as indicated at 13, depresses a trigger 200 mounted on the portion of the table top 14, as best seen in FIG. 2, which is disposed between the belts 40 which works through a mechanism later described to disengage a clutch later described so that the drive from the gear head motor 190 is interrupted whereby the conveyor belts 40 and 60 cease to rotate.

The purpose of the stopping of the package is so that it can receive a strap on that portion of the package 12 which is disposed beneath the yoke 28 at the time the box 12 stops.

An automatic strap position controling assembly is generally indicated in FIG. 2 at 198, having a plurality of automatic strap position control elements, a first one of which is a trigger 200.

The box 12 will stop after a period of delay time after depression of the automatic strap-position controlling assembly 199, generally indicated in FIG. 2 at 198, having a plurality of automatic strap-position control elements, a first one of trigger 200 because mechanism later described will not cause the belts 40 to stop until after the period of delay time and until the box 12 has reached, for example, the position shown in FIG. 1, which is the position in which a strap is to be applied under the yoke 28 a short space from and adjacent the forward end 13 of the box 12.

Referring again to FIG. 1, the forward end strap is there shown at 220 disposed beneath the yoke 28. A rearward end strap is diagrammatically and partially shown at 230 in FIG. 1 on the package 12. It is probably helpful to mention that the package 12 will also receive a rear end strap 230 which is in FIG. 1 only diagrammatically shown and partially shown because when the package is in the position shown in FIG. 1 it would not have been applied to the package yet. It is desired that the strap 230 be spaced the same distance from the rearward end 233 of the package 12 or box 12 that the forward end strap 220 is from the forward end 13 of the box 12.

The package or box 12 can also be called an object or workpiece 12, since it can be of almost any shape.

The trigger 200 does double duty. For example, when the rearward end 233 of the box 12 passes across the trigger 200, the trigger 200 will raise up by spring action, as later described, and its raising up will be a second triggering initiating a second delay period followed by a second stopping of the belts 40 and 60 at a time when the box 12 is with its rearward end portion under the yoke 28 for attaching the strap 230 just described.

Since the raising of the trigger 200 is regulated by nothing else other than the passage of the rearward end of the workpiece or box 12, it can be seen how its operation will position a strap at a certain distance from the rearward end of the object or box 12.

When the rear end strap 230 has already been applied, the mechanism later described will cause the drive of the belt to start up again moving the box 12 off on to an off-ramp 240, which latter can have an inclined upper surface diagrammatically shown at 242, optionally.

The strapper 30 has a reel 246, seen in FIGS. 1 and 2, which delivers strapping material 250 into the area under the yoke 28 which is an open area 260. The reel 246 is mounted on a frame for rotation by carrying means 254, as best seen in FIG. 3.

The reel 246 is all part of a prior art strapping machine.

Figure 3:
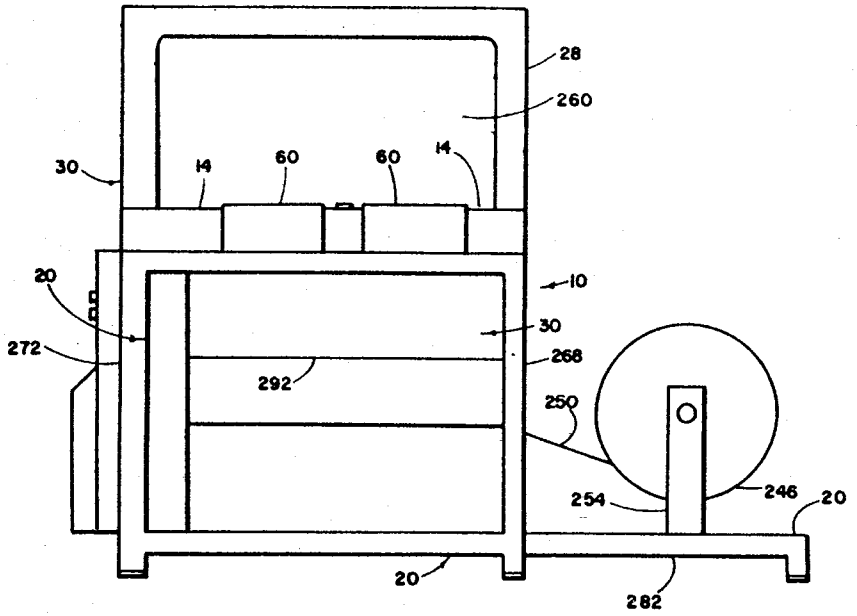
FIG. 3 is a left-end view of the strapper feed conveyor of FIG. 1 without the in and out ramps being shown.

The reel 246 and its carrier 254 and all other parts of the strapper, including a yoke 28 and the body of a strapper 258, seen in FIG. 3 and FIG. 2, are all removable from the frame 20 easily. For example, the carrier 254 can have rails 266 on their underside, the rails 266 extending from beyond the right side 268 to beyond the left side 272 of the frame 20, as seen in FIG. 3, and can further extend beyond the right side 268, as best seen in FIG. 3, a further distance outward to the right in order to extend under the reel 246.

The rails 266 are carried by portions 268 of the frame 20, as best seen in FIG. 1, in a slidable manner so that the entire strapper 30 can be slid out away from a certain extension 282 of the frame 20, best seen in FIG. 3, and extending under the reel 246, for complete removal of the strapper 30 for repair or replacement.

In FIG. 3, the lower end of the area occupied by the mechanism of the strapper is indicated by a line at 292 and mechanism disposed immediately beneath the line 292 is occupied by what is called a strap-accumulator which is simply a part of the prior art strapper 30.

Referring to FIG. 1, a tripper 300 is disposed between the belts 60 and extends upwardly from that portion of the table top 14 which is disposed between the belts 60. The purpose of the tripper 300 is to control the application of one or more other intermediate straps to the box 12. The tripper 300 is similar to the trigger 200, but each operate different mechanisms, as later described.

A unique feature is that the downstream tripper 300, even if it is depressed, will not initiate intermediate strappings on a box, if that box has had its rearward end 233 pass across the trigger 200 before the forward end of the box depresses the tripper 300. This has the advantage that even though the cycling mechanism for intermediate straps is in motion, yet no intermediate straps will be applied, even though the tripper 300 is depressed, if the intermediate straps are not needed because the rearward end 233 of the box has already passed by the trigger 200 indicating that the box 12 is really not very long, not long enough to need intermediate straps.

Figure 4:
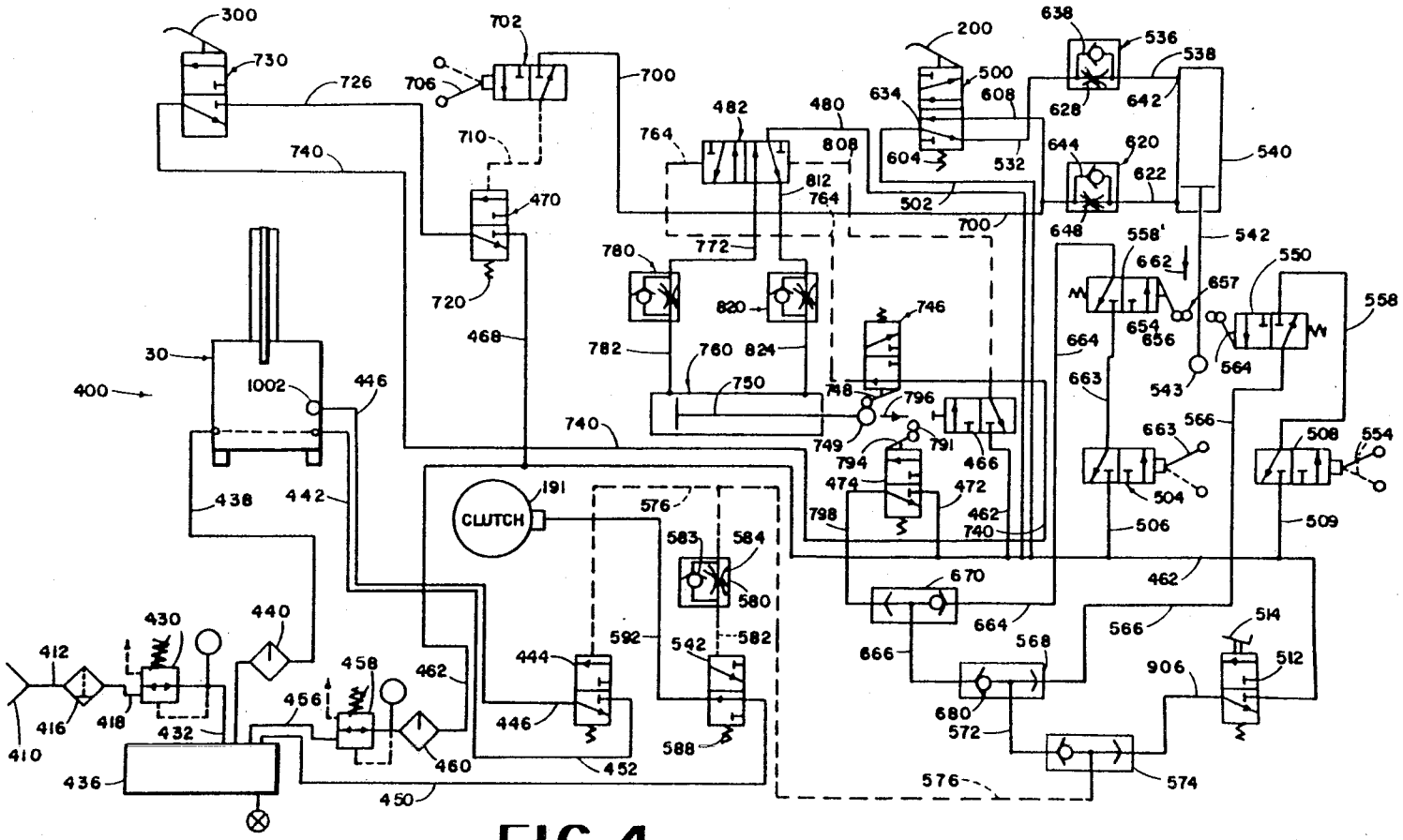
FIG. 4 is a diagram of the pneumatic system of the strapper feed conveyor of this invention.

Referring now to FIG. 4, the pneumatic assembly of this invention is generaly indicated at 400 in FIG. 4 and comprises a source of air 410 from which air flows through line 412 to the filter water separator 416 which first filters the water out of the air and then separates the water from the air in conventional manner, delivering the air to a line 418 which carries it to a pressure regulator valve 430 which has a blow-down. The symbols used in FIG. 4 are symbols of the J.I.C. symbol system which is a standard system for air circuitry and, consequently, once a symbol has been identified, its details of operation will be known from the conventional symbolism used.

Air flows from the valve 430 through a line 432 to a manifold 436 which functions as an accumulator of the air.

The strapper 30 at the left-side of FIG. 4 is an air-powered strapping machine such as, for example, the A.P.M-2A made by Food Machinery Corporation in their Film and Packaging Division, 1617 John F. Kennedy Boulevard, Philadelphia, Pennsylvania 19103.

The strapper 30 receives air through a line 438 in which is an air line lubricator 440. An air line 442 from the strapper 30 leads to the valve 444 which is a spring return pilot operated three-way normally closed valve. The valve 444, when actuated, returns a signal through a line 446 to the strapper 30 for the purpose of initiating a strapping cycle of the machine 30. A line 450 leads from the manifold 436 through a valve 552 to the clutch 191 through a normally open valve 552, which latter is a normally open valve which is spring return air pilot actuated and is a three-way valve, whereby the clutch 191 is ordinarily driving the chain 180 for causing the conveyor belts 40 and 60 to be in movement.

A safety feature is that the conveyor belts 40 and 60 will not move even if electrical power is reaching the gear head motor 190 as long as the air supply through the valve 552 is shut off.

Air supply from the manifold 436 also goes through an additional miniature regulator valve 458 which is a pressure regulator valve with blow-down, the line 456 having the valve 458 in it and leading to an air line lubricator 460 from which air passes through a line 462 to supply the control circuitry with air. The reason for the additional regulator 458 is to reduce the control air to at least ten pounds below the supply air to always maintain an exact pressure which in turn always maintains an exact timing cycle for the entire in-feed/out-feed cycling earlier described.

Through the same lubricator 460 air is supplied to a normally closed valve 466 which is a three-way valve of the spring return plunger actuated type. A line 468 leads from the line 462 carrying air to a normally closed valve 470 of the spring return air pilot three-way normally closed type. A line 472 carries air from the line 462 to a normally closed valve 474 of the spring return one-way roller lever actuated three-way normally closed valve.

A line 480 connected to the line 462 delivers air to a four-way valve 482 which is a double air pilot four-way valve.

The trigger 200, earlier described, is connected to and forms a part of and controls a control valve 500 which receives air through a line 502 from the air line 462. The control valve 500 is a spring return lever actuated four-way valve.

An on/off valve 504 receives air through a line 506 connected to the line 462, the valve 504 being a toggle action three-way valve.

An on/off valve 508 receives air through a line 509 from the line 462. The valve 508 is a toggle action three-way valve.

A foot valve 512 receives air from the line 462 and is a spring return foot pedal operated three-way normally closed valve controlled by a foot pedal 514 disposed at a convenient place for an operator, such as on the floor adjacent the machine.

In the above part of the Description of FIG. 4, the "at rest" position of all valves as shown on the diagram of FIG. 4 has been described so as to describe the entire mechanism as being in a position for "start attitude".

The air supply to the initial contact switch 500, when the lever 200 is in the normal or "up" position admits air up through the line 462 and 502 and through the control valve 500 through line 532 to full control 536 and from the latter through line 538 into the air cylinder 540 causing the plunger 542 of the air cylinder 540 to extend to its outer extreme.

As long as there is no action on any control or valves which would affect the cylinder 540, the plunger 542 will remain in the "out" position, meaning out to its extremity, with the ball 543 on the end of the piston rod 542 extended past a first cycling valve 550 and also passed a second cycling valve 558.

The first cycling valve 550 is for the applying of a first strap, the second cycling valve 558 is for the applying for the second strap.

To clear the pneumatic assembly 400 to FIG. 4 so as to prepare it for initiating the applying of two straps to a carton, a first manual strap selection valve 508, earlier mentioned, is manipulated by moving its manual lever 554 from the dotted line position shown in FIG. 4 to the full line position so as to set the manual strap selection first valve 508 in a position for the application of a first strap to a carton.

The purpose of the selection valve 508 is to admit air coming along the line 462 and 509 through the valve 508 and through a line 558 to the first cycling valve 550. Since this puts air in the first cycling valve 550 any retraction of the plunger 543 back toward its cylinder 540 will initiate a strapping cycle by striking a lever 564 which has the effect of admitting air that passes from the line 558 to the first cycling valve 550 on through the valve 550 to a line 566 so as to reach a first shuttle valve 568. The air leaving the first shuttle valve 568 goes through a line 572 to a second shuttle valve 574.

Air from the second shuttle valve 574 leaves the valve 574 along the dotted arrow line 576 whereby it simultaneously actuates a clutch control valve 552, earlier described and a strapping cycler valve 444 earlier mentioned.

For actuating a first belt stopping valve (this actuation is a shifting of the valve 550) for initiating the signal. The shifting being an opening of the valve 550 sending two signals, one to an air valve 542 which exhausts air from the air operated spring opening clutch 191, causing an immediate stoppage of the belt.

The line 566 from the valve 550 to the valve 542 passes through two shuttle valves 568 and 574 and through a dotted line 576 to control the exhaust 542 with the clutch 191. The two shuttle valves are a shuttle valve 568 for combining two signals into one so that the same signal through the line 566.

The way the air reaches the clutch release valve line 576 is through a second flow control valve 580 which goes in a line 582 which branches off from the line 576 and extends to the clutch release valve 452.

The second flow control 580 has a check valve 582 in it which permits flow through the line 582 only toward the clutch release valve 452 although air does flow along the line 452 to the clutch release valve 454 anyway through an orifice line 584 of the second flow control 580 which latter is in parallel with the check valve 582. The orifice line 584 is for the purpose of letting air back out from the clutch release valve 452 slowly along the line 582 back to the line 576 so that the clutch release valve remains open so long as the air pressure in it in the line 582 is overcoming the spring of 588 of the clutch release valve 452.

The orifice 584 is of a size particularly selected so as to release air through the line 582 at a rate of speed for keeping the clutch release valve 542 closed for a substantial period of time by overcoming the effect of its spring 588 which latter maintains the clutch release valve 452 in a normally open condition.

The orifice 584 is adjustable so that the timing is variable.

The purpose of the timed orifice 584 is to keep the clutch release valve 452 closed for a desired period of time long enough for a strap to be put on a carton since the clutch release valve 452, when closed, prevents air passing from the line 450 through the valve 452 from reaching the line 592 to the clutch 191 so that the absence of air reaching the clutch 191 keeps the feed belts 40 of FIG. 2 stopped, simultaneously stopping the outfeed belt 50 of FIG. 2.

Since the line 576 also goes to a strapper cycling valve 444, earlier mentioned, the strapper cycling valve 444 initiates an air flow along the line 446 to the strapper 30 for initiating the application of one strap called a first strap.

So above-described is the resultant application of a first strap 220 to the carton 233 resultant from a tripping of the trigger 200 of FIG. 1 and of FIG. 4.

Next, in FIG. 4 when the air has completely passed through the orifice 584 of the second flow control 580, being urged by the spring 588, this completion of a bleed-off of air will cause the clutch release valve 452 to return to its normally open position sending air to the clutch 191 which energizes the belts 40 and 60 to move the carton forward in a direction of an arrow 600 in FIG. 1. The carton 233 will then continue to move forward until it has passed completely across the trigger 200 whereby the trigger 200 rises under the influence of a spring diagrammatically shown at 604 in FIG. 4. So, what has happens is that when the trigger 200 is no longer being pressed downwardly by the carton, the spring 604 so operates the multiple control valve 500 as to return it to its original rest postion whereby it admits air from the line 502 therethrough to a line 608 reaching a third flow control valve 620. The air flowing into the third flow control valve 620 leaves it in full force through a line 622 to one end of the cylinder 540 causing the cylinder to contract while at the same time air out the other end port of the cylinder 540 enters the line 538 previously mentioned and flows through a variable orifice 628 to the line 630 and back to the control valve 500 which latter at that time is in a position for causing the air from the line 532 to be exhausted or dumped into the atmosphere at a port 634 of the valve 500.

Orifice 628 is variable for adjustment. Its variations determine the length of time for exhausting air whereby it controls the speed of the plunger 532 which in turn controls the distance that the belt travels before the respective strap is put in place. The variable orifice 628 of the first flow control valve 536 controls the delayed action time between the release and rising of the trigger 200 and the placement of the second strap 220 on the carton 233.

The first flow control valve 536 also has a check valve 638 in parallelism with the variable orifice 628 and adapted to permit flow to bypass the variable orifice 628 only at times when air is being admitted into the upper or inner port 642 of the cylinder 540.

When it was earlier stated that flow proceeded along the line 608 to the line 622, that flow was freely accomplished along a bypass check valve 644 disposed in parallel with a variable orifice 648 of the third flow control valve 620 whereby the variable orifice 648 was bypassed.

When the plunger 542 moves outward from its cylinder it passes by the end of a lever 654 of the second cycling valve 558. The outer end of the lever 654 is engageable by an intermediate roller 656 which depresses the lever 654 at times when the intermediate roller 656 is struck by the actuator tip 543 of the plunger 542 as the actuator tip 543 is moving in the direction of the arrow 662.

However, whenever the plunger 542 is moving in the direction opposite to the arrow 662 or in other words, back in toward its cylinder, then an engagement of the actuator tip 543 with the intermediate roller 656 will not depress the lever 654 because it will only cause the intermediate roller 656 to be displaced in a manner for automatically coming back again into its position shown on FIG. 4 by means of parts not shown which latter form a part of a one-way overriding mechanism which can be considered to be generally indicated at 657, the latter mechanism including the intermediate roller 656 and any parts attached to the lever 654 and plunger 542 which accomplish the one-way action above described for depressing the levers 654 only at times when the plunger goes by in the direction of the arrow 662, which is a "one-way".

Flow from the on/off valve 504, when its control, 663 is in the on position as shown in FIG. 4 proceeds through a line 663 to the second cycling valve 558 prime and from thence to a line 664 when the lever 654 is depressed.

Flow from the line 664 reaches a third shuttle valve 670 constructed in the same way as the shuttle valve 568. Flow from the third shuttle valve 670 proceeds along a line 666 to a part of the first shuttle valve 568 whereby it forces the ball 680 of the latter to open position permitting flow through the line 572 to open the second shuttle valve 574 permitting flow along the dotted line 576 back to carry out operations earlier described, namely; clutch disengagement to shut off drive of the conveyor belts and the initiation of a cycle during which a strap is applied to the container.

Simultaneously as the control valve 500 is delivering air through the line 608 to the third flow control 620, a line 700 connected to the line 608 delivers flow over to a third on-off manual valve 702.

A third manual valve 702 has a control 706 which is also seen in FIG. 2 and when the control 706 is in an on position then flow through the third manual valve 702 proceeds along a dotted line 710 to the normally closed valve 470, which latter when pressured along the line 710 has its parts in position for permitting flow from the line 468 earlier mentioned to the line 726 to the tripper control valve generally indicated at 730.

The Purpose of having the circuit involving the line 700, the third manual control valve 702, the normally closed valve 470, the line 726 and the tripper valve 730 is so that strapping to be initiated by depression of the tripper 300 by engagement by a carton will be a strapping that will not occur unless the trigger 200 is also depressed at the same time, because of the circuit just described.

With the tripper 300 depressed, its tripper valve 730 sends a signal down through a line 740 to an intermediate strapping control valve 746 which latter has a control valve 748 depressed at times by the actuator tip 749 of a plunger 750 of a cylinder and plunger assembly 760 which latter can be called; the intermediate strap timing cylinder assembly 760 which latter has a piston or plunger 750 the actuator tip 749 of which engages the control lever 748 of the intermediate strapping control valve 746. As shown in FIG. 4 the actuator tip 749 is holding the intermediate strapping control valve lever 748 for holding the valve 746 in open position permitting air to flow through line 740 and through the intermediate strapping control valve 746 out along a dotted line 764 to the intermediate strapping cylinder power valve 482 which latter is a four-way valve, specifically a double air pilot four-way valve.

Air passing along the line 764 causes the valve 482 to shift in a manner for permitting air passed from the line 480 to the line 772 which leads to a fourth flow control valve 780 from which flow exits on a line 782 to the back port of a cylinder assembly 760 for causing the cylinder assembly 760 to expand for causing the actuator tip 749 thereof to move from the full line position shown in FIG. 4 over to a position where it will strike intermediate roller 791 for causing depression of a control lever 794 of the valve 474 only at times when the actuator tip strikes the intermediate roller 791 as the actuator tip is moving in the direction of arrow 796. The depression of the levers 794 causes air to be admitted through the line 472 to a line 798 which causes that port of the third shuttle valve 790 which is opposite the line 664 to be pressurized for permitting flow to pass down only through the line 666 so as to control the first shuttle valve 568 and the second shuttle valve 574 so as to initiate the stopping of the conveyor and strapping which is the application of the intermediate strap 800 of FIG. 1, to a place on the carton 12 which is between the end straps 220 and 230.

As the piston 750 extends in the direction of the arrow 796 further, its actuator tip passes by the roller 791 and strikes a control 802 of the spring return plunger three-way control valve 466 earlier described which latter is a piston return valve for intermediate strapping which permits delivery of flow from the line 462 through a dotted line 808 to the opposite end of the four way intermediate strapping cylinder control valve 482 from the line 764 whereby air from the line 480 is admitted to the line 812 carrying flow down to the fifth flow control shuttle valve 820 for intermediate strapping which latter delivers flow through a line 824 to the forward port of the cylinder assembly 760 for causing the piston 750 to retract whereby it strikes the control lever 748 of the intermediate strapping control of 746 which latter has the effect of causing the piston 750 to move back out again. The piston 750 therefore, moves back and forth, and back and forth and each time it goes out a strap is applied and each time it goes back it prepares the mechanism for the next out movement of the piston 750 although these things do not occur unless there is a depression of both the tripper 300 and the trigger 200 simultaneously.

Referring to FIG. 1, it may be desirable to add one or more additional intermediate straps such as the strap 900 shown there on dotted line in between the end straps and the automatic intermediate strap 800, the strap 900 being added by means of a foot pedal 514 earlier mentioned whereby each time the foot pedal 514 is depressed an additional strap 900 is put on the object or carton 12.

The flow when the foot pedal 514 is depressed is from the line 462 out from the valve 512 through a line 906 to the opposite port of the second shuttle valve 574 from the line 572, whereby flow is caused out through the line 576 to cause belt stoppage and strapper application, as previously described.

Adjustment of the machine can be done in many ways. For Example: the spacing of the forward end strap 220 from the forward end of the carton 13 is done by manually adjusting the valve 628 of the first flow control 536 so as to either increase or decrease the speed of the exhausting of air from the cylinder assembly 540, specifically; a speedier flow of air through the line 538 will cause the first strap 220 to be closer to the adjacent end 13 of the carton 12 and a slower flow of air through the line 538 and valve 628 will cause the first strap 220 to be farther from the forward end 13 of the carton.

The flow control valve 648 can be adjusted for a speedier flow of air in which case places the second strap 230 farther from the trailing edge 233 of the carton 12. Likewise, a slower flow through the valve 648 will place the second strap 230 closer to the trailing edge 233 of the carton 12.

Adjustment at the fourth flow control valve 780 will permit faster flow if desired through the line 782 which will allow the plunger 750 to move faster when it is retracting (since these flow control valves all have to do with control of outflowing air from these cylinders) whereby the strap applied at the time the actuator tip 749 strikes the lever 748 of the intermediate strapping control valve 746 occurs sooner for causing a strap to be placed on the carton a little sooner, or in other words; at a lesser interval than the last strap applied (which the last strap applied of the intermediate strap) as distinguished from the first and last straps 220 and 230.

When a long pole is involved instead of a small carton such as shown in FIG. 1 then it is desired that the intermediate straps between the end straps 220 and 230 be spaced automatically exact distances apart, equally distantly spaced with respect to each other and also spaced continuously automatically until such time as the rear end of the pole or other long object has ceased to be depressing the trigger 200. The spacing of this bunch of intermediate straps that are automatically put on is done by control of the speed of shuttling back and forth of the piston 750 as is controlled in turn by adjustment manually of the fourth and fifth control valve 780 and 820.

Of the fourth control valve 780 and fifth control valve 820 functions, a point of distinction is to be made. The fourth control valve 780 is adjusted to determine the spacing of the automatically intermediate straps, one of which is shown at 800 (as distinguished from the foot pedal straps shown at "F" and 900).

The fifth flow control valve 820 is manually adjustable for adjusting the space between the first strap 220 and the first to be applied of the automatically applied intermediate straps labeled "A" and shown at 800 and 801 so as to illustrate two of a possible many automatically equally distanced straps labeled in each case "A" because they are automatically applied straps as distinguished from the strap labeled "F" which latter is a foot pedal applied strap. It is understood that as many foot pedal applied straps can be put on as desired, one for every time the foot pedal 514 is depressed.

A very, very short carton would tend to receive only two straps because its rearward end would have ceased to depress the trigger 200 by the time its forward end has depressed the trigger control elements 300. This means that all the controls can be left on and yet an automatic strapping can occur with the ideal number of straps being applied so that if a small carton comes in between long poles then the small carton will perhaps, if it is short enough, will receive only end straps whereas the long pole will receive not only end straps but automatically applied intermediately appliable straps, the foot pedal applied straps "F" being an entirely separate matter and coming at the operator's will. Another automatic feature is for super small objects and cartons, which latter are so short that they receive only one strap because by the time the signal is sent by the trigger or control elements 200 the carton will have moved off the trigger or control elements 200 before the conveyor even has a chance for stopping the first time and yet since one signal has been sent, indeed, one strap therefore will be applied. So a beautifully automatic machine is thus provided.

Once the patterns have been set as described everything will work automatically as set. And yet, if any different spacing or any different number of straps is desired the various flow controls can be set for gaining different spacings and numbers of straps to be automatically applied.

In addition, the position of the trigger 200 is physically adjustable with respect to the length of the table top in the direction of flow of the belt top so as to provide still another kind of adjustment. So that the position of the first strap from the forward end of the carton can be really adjusted two ways, (1) by physically adjusting the position of the trigger 200 with respect to the length to the frame carrying the belt, and (2) also by adjustment of flow control valves as above described.

This has particular advantage because it is often simpler to adjust the position of the trigger 200 with respect to the frame as regards to the direction of carton and belt flow than it is to readjust the flow control valves.

Another interesting feature is that the width and height of the carton can very as much as from a carton so large as to barely go through the yoke of the strapper on down to a very thin pole and still all the other functions of the automatic strapping will be as described. This is because the entire machine is shut down until such time as the strapper itself has completed its strapping (which would seem erroneously to be a longer time with a bulkier package but is actually a shorter time with a bulkier package because of the time it takes for the strapper to adjust itself automatically down to the business of strapping an object that is thin, such as a pole).

In FIG. 2 a button 1000 is for simply turning the conveyor motor on and off at the start and end of a work shift usually.

An air switch 1002, seen in FIG. 4, center of the left end, is shown on the strapper 30 which is operated automatically whenever the line 446 is pressurized to initiate strapping.

The various symbols in the drawing of FIG. 4 are J. I. C. Standard Symbols, generally accepted industry wide for air circuitry.

I claim:

1. A strapper feed conveyor comprising: a frame, said frame having two belt conveyors thereon traveling in a same direction, each of said belt conveyors having a belt, the exit end of one of said conveyors being spaced from the entrance end of the second one of said conveyors, drive means on said frame comprising a motor for synchronously driving said conveyors, said frame being absent in a space between said conveyors for providing a strapping space, a strapping machine mounted on said frame for applying a strap around an object on said conveyors as said object passes across said strapping space, automatic strap position controlling means mounted on said frame and operably correlated with said conveyor drive means and controlling said conveyors and said strapper in a manner so as to apply a first-strap onto an object at a desired location with respect to the forward end of said object, said automatic strap-position controlling means having a control element means forming a part thereof and having a first control element fixed to said frame so that the forward end of said object depresses said first control element when said forward end passes over said first control element whereby the position of the forward end of said object moving through said machine determines automatically the position on said object of a first-strap, and means urging said first control element into a position above the belt of said first conveyor whenever such an object is not on said control element means, said automatic strap-position controlling means comprising said control element means and an air powered timing assembly, said timing assembly having adjustable means thereon for changing the effect of air pressure in said timing assembly whereby the timing of the application of said first-strap to said object is variable so as to accomplish the selective spacing of said first-strap from the forward end of said object.

2. The strapper conveyor of claim 1 having said strap position controlling means being operably correlated with said first control element whereby said automatic strap position controlling means causes the application of another strap onto said object rearwardly of said first strap as a result of a rising of said first control element because of said urging means and because of the passage of the rearward end of said object across said first control element thereby permitting said first control element to rise above said belt.

3. The strapper feed conveyor of claim 2 having said belts comprising a belt assembly, said automatic strap position control means having a second control element fixed to said frame so as to project above said belt assembly a substantial distance forwardly in the direction of belt travel from said first control element so that when an object is quite long it will depress said second control element and said first control element simultaneously, means urging said second control element into a position above said belt assembly, said simultaneous depression initiating application by said automatic strap position controlling means of an intermediate strap disposed between said first strap and said other strap.

4. The strapper feed conveyor of claim 1 having said strap position control means having a source of pneumatic pressure and having a moving part, said strap position control means having means moveably mounting said part and providing air passages permitting air to move toward and away from said part, said moving part moving at times by air pressure striking said part, presetable variable valving means in at least one of said air passages and defining said adjustable means for changing the effect of air pressure, said valving means controlling the effect of said air pressure for moving said part so as to control the speed of movement of said part, means correlating movement of said part and operation of said strapper for causing said strapper to apply a strap at a desired time after said first control element is depressed such as by the forward end of said object, said time being variable by a pre-setting of said valve means.

5. The strapper conveyor of claim 1 having said automatic strap position control means comprising a plurality of control elements all of which are operably correlated with said strap position controlling means and all of which are depressable by objects passing there over on said belt and can rise like said first mentioned strap position controlling element, similar urging means for each of said control elements whereby said automatic strap position controlling means causes the application of another strap onto said object rearwardly of said first strap as a result of a rising of one of said control elements because of its said urging means and because of the passage of the rearward end of said object across said one control element thereby permitting said one control element to rise above said belt.

* * * * *